US009520632B2

(12) United States Patent
Jin et al.

(10) Patent No.: US 9,520,632 B2
(45) Date of Patent: Dec. 13, 2016

(54) CMOS BAND-PASS FILTER

(71) Applicant: Taiwan Semiconductor Manufacturing Company Limited, Hsin-Chu (TW)

(72) Inventors: Jun-De Jin, Hsinchu (TW); Tzu-Jin Yeh, Hsinchu (TW); Chewn-Pu Jou, Hsinchu (TW)

(73) Assignee: Tiawan Semiconductor Manufacturing Company Limited, Hsin-Chu (TW)

( * ) Notice: Subject to any disclaimer, the term of this patent is extended or adjusted under 35 U.S.C. 154(b) by 191 days.

(21) Appl. No.: 14/166,755

(22) Filed: Jan. 28, 2014

(65) Prior Publication Data

US 2014/0266512 A1 Sep. 18, 2014

Related U.S. Application Data

(63) Continuation of application No. 14/103,998, filed on Dec. 12, 2013, now abandoned.

(60) Provisional application No. 61/798,277, filed on Mar. 15, 2013.

(51) Int. Cl.
*H01P 1/20* (2006.01)
*H01P 1/207* (2006.01)

(52) U.S. Cl.
CPC ..... *H01P 1/207* (2013.01)

(58) Field of Classification Search
CPC ..... H01P 1/207
USPC ..... 333/202
See application file for complete search history.

(56) References Cited

U.S. PATENT DOCUMENTS 3,560,894 A * 2/1971 Fettweis ..... H03H 9/542 333/190
6,215,374 B1 * 4/2001 Petrovic ..... H03H 7/1775 333/177
7,272,367 B2 * 9/2007 Amano ..... H03H 7/09 333/132
2002/0093400 A1 * 7/2002 Zhu ..... H01P 1/20336 333/205
2003/0199105 A1 * 10/2003 Kub ..... H01L 21/76254 438/3
2013/0033338 A1 * 2/2013 Wang ..... H03H 3/0072 333/186
2013/0106533 A1 * 5/2013 Ayazi ..... H03H 3/0072 333/186
2013/0285676 A1 * 10/2013 Rahafrooz ..... H03H 3/0072 324/633

* cited by examiner

*Primary Examiner* — Stephen E Jones
*Assistant Examiner* — Scott S Outten
(74) *Attorney, Agent, or Firm* — Cooper Legal Group, LLC

(57) ABSTRACT

A band-pass filter is provided that is configured to output a signal with a frequency within a desired frequency range and to attenuate signals with frequencies outside the desired frequency range. The band-pass filter comprises a CMOS resonator that comprises a resonator cavity and a reflector. The band-pass filter also comprises an impedance convertor that is configured to inhibit at least some insertion losses on the band-pass filter. The band-pass filter also comprises a variable capacitor that is connected between the CMOS resonator and the impedance convertor. The desired frequency range of the band-pass filter can be tuned by adjusting the capacitance of the variable capacitor.

20 Claims, 6 Drawing Sheets

CMOS BAND-PASS FILTER

BACKGROUND

As consumers continue to demand thinner, lighter, and smaller electronic devices, the premium placed on real-estate within such devices has grown. Accordingly, semiconductor manufacturers are pressed to reduce the size of the circuitry, often without compromising performance of the device. One type of circuit design that has grown in popularity due to this demand for smaller, faster, and/or more energy efficient circuitry is circuitry that comprises complementary-metal-oxide-semiconductors (CMOSs).

DETAILED DESCRIPTION

Figure 1:
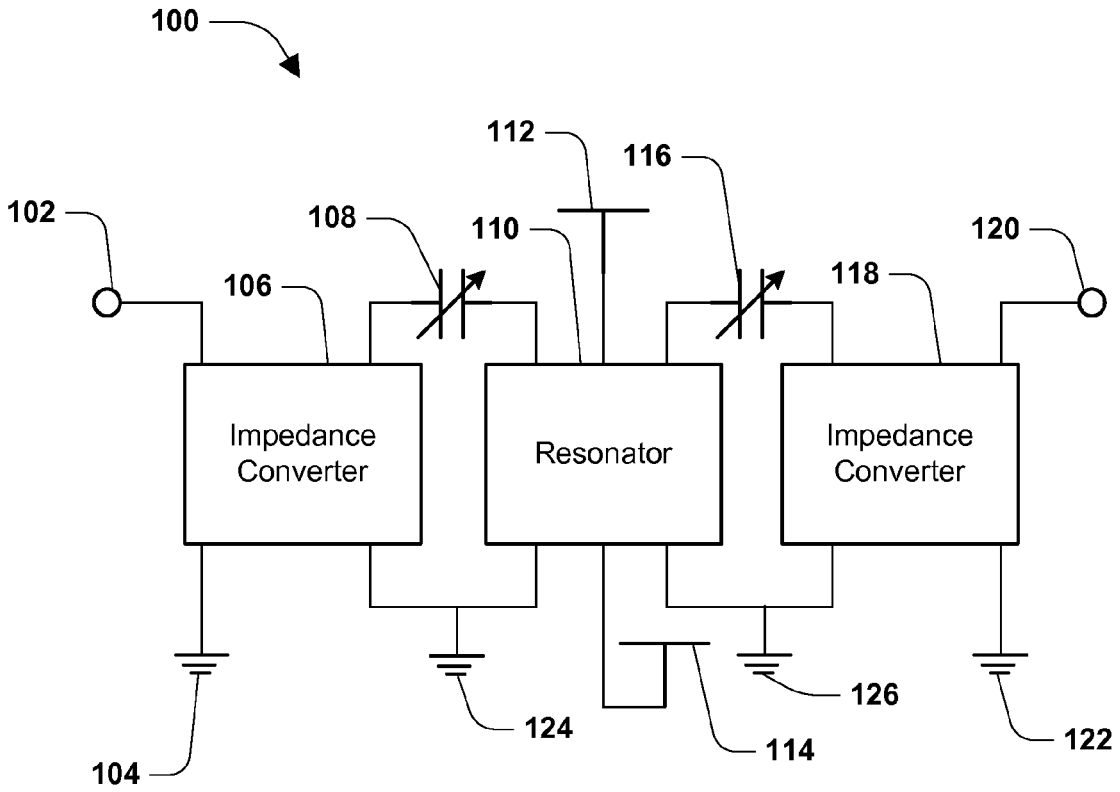
FIG. 1 is an illustration of a circuit, according to some embodiments.

Embodiments or examples, illustrated in the drawings are disclosed below using specific language. It will nevertheless be understood that the embodiments or examples are not intended to be limiting. Any alterations and modifications in the disclosed embodiments, and any further applications of the principles disclosed in this document are contemplated as would normally occur to one of ordinary skill in the pertinent art.

A band-pass filter is configured to output signals having frequencies within a desired range while attenuating or inhibiting signals having frequencies outside the desired range.

In some embodiments, a band-pass filter comprising a resonator is provided. In some embodiments, the resonator comprises a resonator cavity, and a reflector pair. The reflector pair comprises a first reflector and a second reflector. In some embodiments, the first reflector is a first acoustic Bragg reflector. In some embodiments, the second reflector is a second acoustic Bragg reflector. In some embodiments, the resonator cavity is positioned between the first reflector and the second reflector. In some embodiments, the resonator is formed on a wafer, such as a silicon wafer and is CMOS compatible. That is, the resonator can be constructed using CMOS design.

In some embodiments, the resonator cavity comprises at least one of aluminum, arsenic, cobalt, copper, germanium, indium, silicon, silicon dioxide or tungsten. In some embodiments, the resonator cavity comprises at least one of an n-type material, such as arsenic. In some embodiments, a motional impedance of the resonator cavity is a function of a product of a mass density and a Young's modulus of a material comprised within the resonator cavity. In some embodiments, it is desirable to limit the motional impedance of the resonator cavity. In some embodiments, the product of the mass density of arsenic and the Young's modulus of arsenic is approximately one-fourth of the product of the mass density of aluminum and the Young's modulus of aluminum. In this way, in some embodiments, a resonator cavity comprising arsenic has less motional impedance than a resonator cavity comprising aluminum. Thus, in some embodiments, the resonator cavity comprising arsenic is favored over the resonator cavity comprising aluminum.

In some embodiments, the first reflector comprises one or more of aluminum, arsenic, boron, cobalt, copper, germanium, indium, silicon, silicon dioxide, or tungsten. In some embodiments, the first reflector comprises silicon and tungsten. In some embodiments, the second reflector comprises one or more of aluminum, arsenic, boron, cobalt, copper, germanium, indium, silicon, silicon dioxide, or tungsten. In some embodiments, the second reflector comprises silicon and tungsten. In some embodiments, a number of trenches defined by the first reflector is a function of a difference in acoustic impedances between the materials used in the first reflector. In some embodiments, a number of trenches defined by the second reflector is a function of a difference in acoustic impedances between the materials used in the second reflector. In some embodiments, the first reflector comprises the same structure and the same materials, respectively, as the second reflector. In some embodiments, a reflectivity of the reflector pair increases as the difference in acoustic impedances between the materials used in the first reflector and the second reflector, respectively, increases. In some embodiments, decreasing the number of trench pairs defined by the reflector pair decreases the reflectivity of the reflector pair. In some embodiments, it is desirable to limit the number of trench pairs defined by the reflector pair to reduce a size of the resonator, and thus to reduce a size of a semiconductor that comprises the resonator. In some embodiments, a reflector pair comprising tungsten and silicon achieves a reflectivity of 1 with approximately 3 trench pairs, whereas a reflector pair comprising silicon and silicon dioxide achieves a reflectivity of 1 with approximately 50 trench pairs. In such embodiments, the reflector comprising tungsten and silicon has fewer reflector pairs and thus occupies less space on a wafer, for example.

In some embodiments, the resonator is connected to one or more impedance converters configured to alter an impedance of the band-pass filter. In some embodiments, such impedance converters are configured to reduce insertion losses on the band-pass filter, for example.

In some embodiments, a variable capacitor is positioned between an impedance converter and the resonator and is configured to tune the band-pass filter. That is, in some embodiments, the resonator is configured to facilitate adjusting a frequency range of the band-pass filter. That is, in some embodiments, the resonator is configured to adjust which signals pass through the band-pass filter and which signals are attenuated by the band-pass filter.

A band pass filter 100 according to some embodiments is illustrated in FIG. 1. The band pass filter 100 comprises an input terminal 102, an output terminal 120, a first impedance converter 106, a second impedance converter 118, a resonator 110, a first variable capacitor 108, and a second variable capacitor 116. In some embodiments, the input terminal 102 is connected to the first impedance converter 106. In some embodiments, the first impedance converter 106 is connected to the resonator 110 via the first variable capacitor 108. In some embodiments, the first impedance converter 106 is connected to the first variable capacitor 108. In some embodiments, the first variable capacitor 108 is connected to the resonator 110. In some embodiments, the resonator 110 is connected to a first voltage source 112. In some embodiments, the first voltage source 112 provides a DC voltage. In some embodiments, the first voltage source 112 provides a voltage that is substantially equal to or greater than negative 10 volts and substantially equal to or less than 10 volts. In some embodiments, the resonator 110 is connected to a second voltage source 114. In some embodiments, the second voltage source 114 provides a DC voltage. In some embodiments, the second voltage source 114 provides a voltage that is substantially equal to or greater than negative 10 volts and substantially equal to or less than 10 volts. In some embodiments, the second impedance converter 118 is connected to the resonator 110 via the second variable capacitor 116. In some embodiments, the resonator 110 is connected to the second variable capacitor 116. In some embodiments, the second variable capacitor 116 is connected to the second impedance converter 118. In some embodiments, the second impedance converter 118 is connected to the output terminal 120. In some embodiments, the first impedance converter 106 is connected to a third voltage source 104. In some embodiments, the third voltage source 104 comprises ground. In some embodiments, the second impedance converter 118 is connected to a fourth voltage source 122. In some embodiments, the fourth voltage source 122 comprises ground. In some embodiments, the first impedance converter 106 and the resonator 110 are respectively connected to a fifth voltage source 124. In some embodiments, the fifth voltage source 124 comprises ground. In some embodiments, the second impedance converter 118 and the resonator 110 are respectively connected to a sixth voltage source 126. In some embodiments, the sixth voltage source 126 comprises ground.

Figure 2:
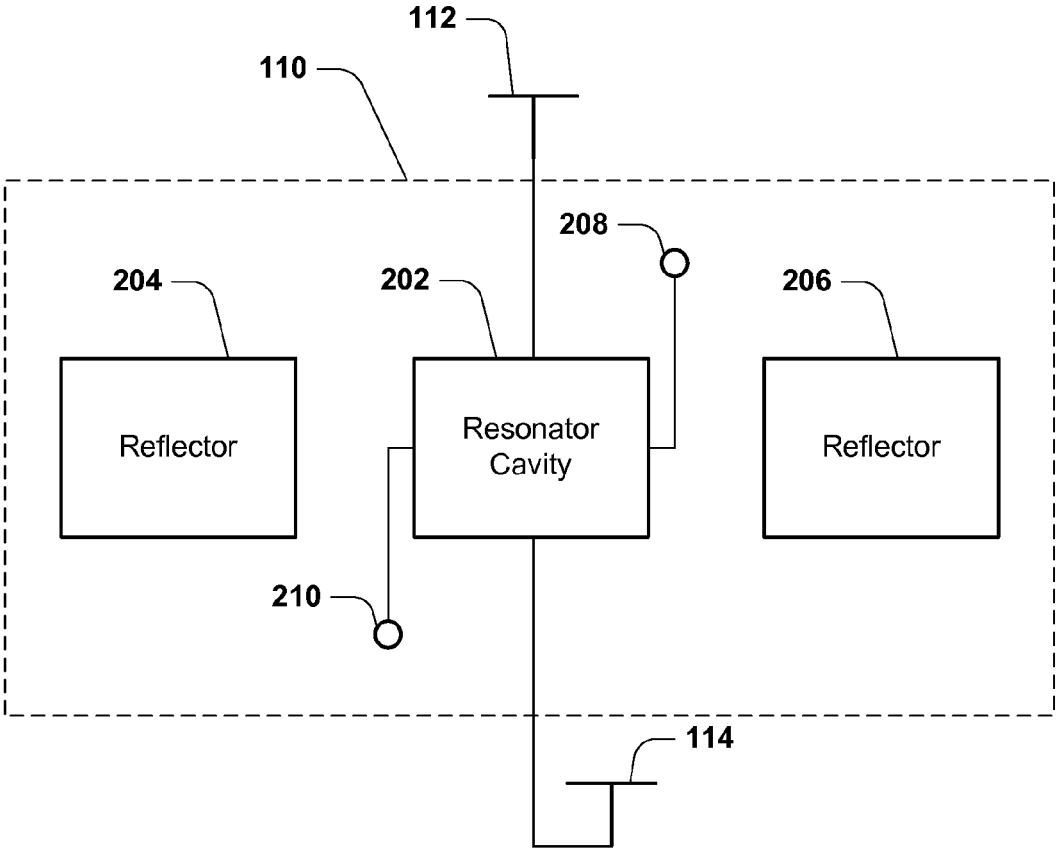
FIG. 2 is an illustration of a circuit, according to some embodiments.

FIG. 2 illustrates the resonator 110 comprised within the band pass filter 100 according to some embodiments. In some embodiments, the resonator 110 comprises a resonator cavity 202, a radio-frequency input terminal 210, a radio-frequency output terminal 208, a first reflector 204, and a second reflector 206. In some embodiments, the resonator cavity 202 is positioned between the first reflector 204 and the second reflector 206. In some embodiments, the resonator cavity 202 is connected to the radio-frequency input terminal 210. In some embodiments, the resonator cavity 202 is also connected to the radio-frequency output terminal 208. In some embodiments, the radio-frequency input terminal 210 is connected to the first variable capacitor 108. In some embodiments, the radio-frequency output terminal 208 is connected to the second variable capacitor 116. In some embodiments, the resonator cavity 202 is connected to the first voltage source 112. In some embodiments, the resonator cavity 202 is connected to the second voltage source 114.

Figure 3A:
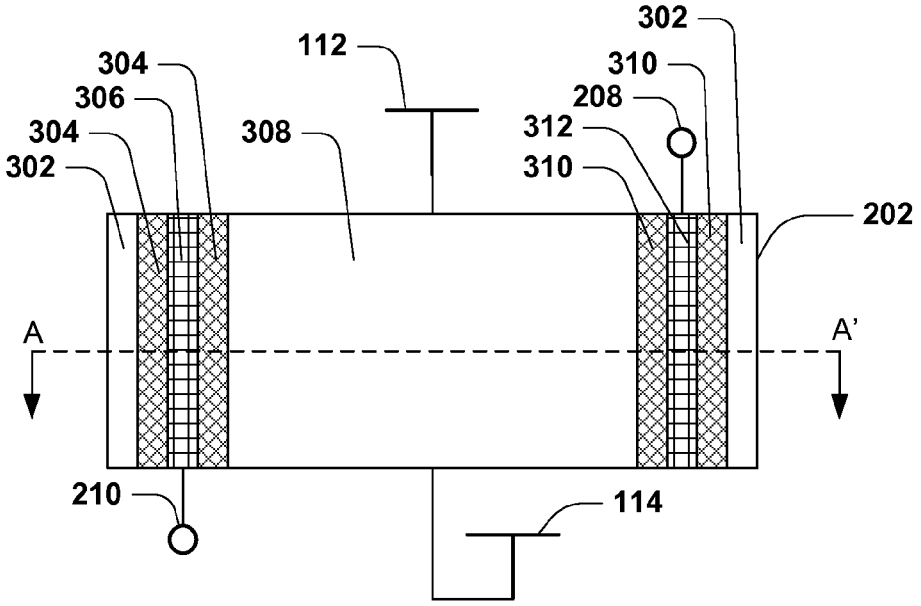
FIG. 3A is an illustration of an integrated circuit structure, according to some embodiments.

FIG. 3A illustrates a top view of the resonator cavity 202 according to some embodiments. In some embodiments, the top view of the resonator cavity 202 comprises a silicon substrate 302, a first segment of silicon nitride 304, a second segment of silicon nitride 310, a first segment of tungsten 306, a second segment of tungsten 312 and a first segment of arsenic 308.

In some embodiments, in the top view of the resonator cavity 202, a first portion of the silicon substrate 302 is adjacent to a first portion of the first segment of silicon nitride 304. In some embodiments, in the top view of the resonator cavity 202, the first portion of the first segment of silicon nitride 304 is adjacent to the first segment of tungsten 306. In some embodiments, in the top view of the resonator cavity 202, the first segment of tungsten 306 is adjacent to a second portion of the first segment of silicon nitride 304. In some embodiments, in the top view of the resonator cavity 202, the second portion of the first segment of silicon nitride 304 is adjacent to the first segment of arsenic 308. In some embodiments, in the top view of the resonator cavity 202, the first segment of arsenic 308 is adjacent to a first portion of the second segment of silicon nitride 310. In some embodiments, in the top view of the resonator cavity 202, the first portion of the second segment of silicon nitride 310 is adjacent to the second segment of tungsten 312. In some embodiments, in the top view of the resonator cavity 202, the second segment of tungsten 312 is adjacent to a second portion of the second segment of silicon nitride 310. In some embodiments, in the top view of the resonator cavity 202, the second portion of the second segment of silicon nitride 310 is adjacent to a second portion of the silicon substrate 302.

In some embodiments, the first voltage source 112 is connected to at least part of the resonator cavity 202. In some embodiments, the second voltage source 114 is connected to at least part of the resonator cavity 202. In some embodiments, the radio-frequency input terminal 210 is connected to at least part of the resonator cavity 202. In some embodiments, the radio-frequency output terminal 208 is connected to at least part of the resonator cavity 202.

Figure 3B:
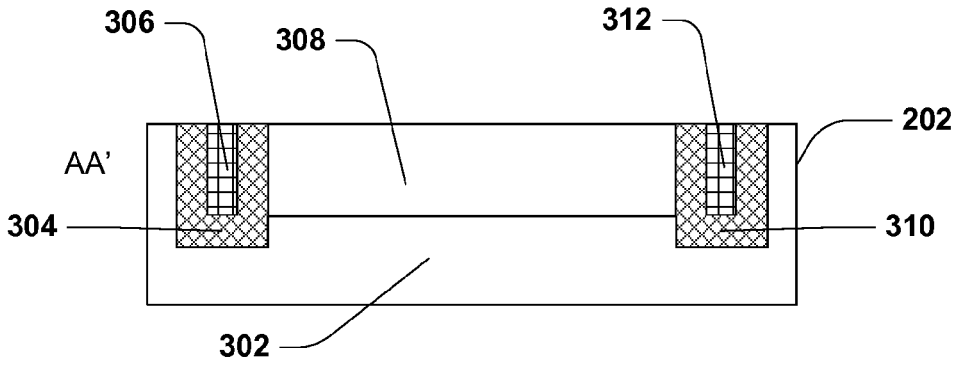
FIG. 3B is an illustration of an integrated circuit structure, according to some embodiments.

FIG. 3B illustrates a cross-sectional area of the resonator cavity 202 according to some embodiments. The cross-sectional area of the resonator cavity 202 comprises the silicon substrate 302, the first segment of silicon nitride 304, the second segment of silicon nitride 310, the first segment of tungsten 306, the second segment of tungsten 312 and the first segment of arsenic 308.

In some embodiments, the silicon substrate 302 defines a first trench. In some embodiments, the first segment of silicon nitride 304 is within the first trench defined by the silicon substrate 302. In some embodiments, the first segment of silicon nitride 304 defines a trench. In some embodiments, the first segment of tungsten 306 is within the trench defined by the first segment of silicon nitride 304. In some embodiments, the first segment of arsenic 308 is adjacent to the first segment of silicon nitride 304. In some embodiments, the second segment of silicon nitride 310 is adjacent to the first segment of arsenic 308. In some embodiments, the silicon substrate 302 defines a second trench. In some embodiments, the second segment of silicon nitride 310 is within the second trench defined by the silicon substrate 302. In some embodiments, the second segment of silicon nitride 310 is situated diametrically opposite the first segment of arsenic 308 relative to the first segment of silicon nitride 304. In some embodiments, the first segment of arsenic 308 is between the first segment of silicon nitride 304 and the second segment of silicon nitride 310. In some embodiments, a trench is defined by the second segment of silicon nitride 310. In some embodiments, the second segment of tungsten 312 is within the trench defined by the second segment of silicon nitride 310.

Figure 4A:
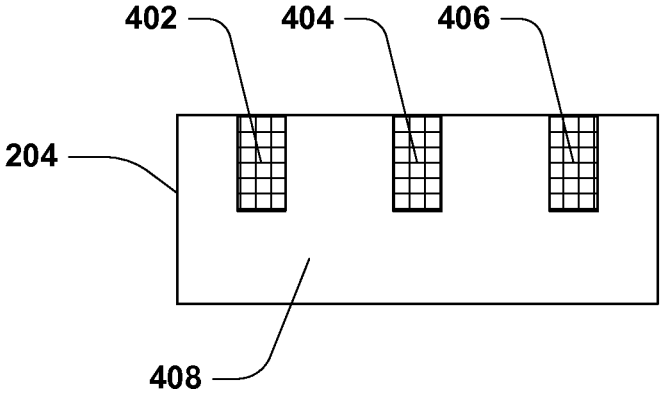
FIG. 4A is an illustration of an integrated circuit structure, according to some embodiments.

FIG. 4A illustrates the first reflector 204 according to some embodiments. In some embodiments, the first reflector 204 is disposed adjacent to the resonator cavity 202, such as to a left side of the resonator cavity 202, as illustrated in FIG. 2. In some embodiments, the first reflector 204 is an acoustic Bragg reflector. In some embodiments, the first reflector 204 comprises a first silicon substrate 408. In some embodiments, In some embodiments, a first trench 402, a second trench 404, and a third trench 406 are defined by the first silicon substrate 408. In some embodiments, the first trench 402 comprises a first segment of tungsten. In some embodiments, the second trench 404 comprises a second segment of tungsten. In some embodiments, the third trench 406 comprises a third segment of tungsten. In some embodiments, the first reflector 204 defines fewer than 50 trenches. In some embodiments, the first reflector 204 defines fewer than 40 trenches. In some embodiments, the first reflector 204 defines fewer than 30 trenches. In some embodiments, the first reflector 204 defines fewer than 20 trenches. In some embodiments, the first reflector 204 defines fewer than 10 trenches.

Figure 4B:
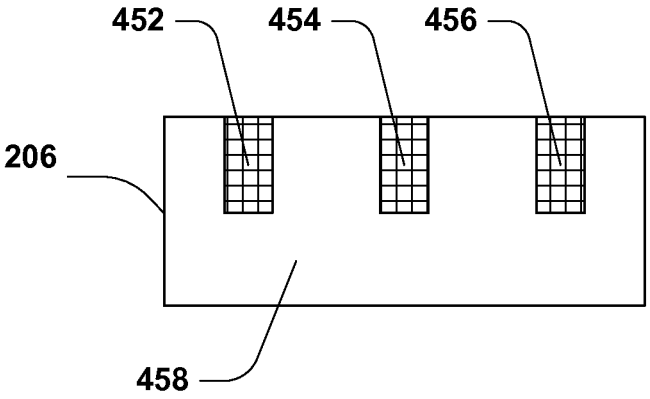
FIG. 4B is an illustration of an integrated circuit structure, according to some embodiments.

FIG. 4B illustrates the second reflector 206 according to some embodiments. In some embodiments, the second reflector 206 is disposed adjacent to the resonator cavity 202, such as to a right side of the resonator cavity 202, as illustrated in FIG. 2. In some embodiments, the second reflector 206 is an acoustic Bragg reflector. In some embodiments, the second reflector 206 comprises a second silicon substrate 458. In some embodiments, the second silicon substrate 458 defines a fourth trench 452, a fifth trench 454 and a sixth trench 456. In some embodiments, a fourth segment of tungsten is within the fourth trench 452. In some embodiments, a fifth segment of tungsten is within the fifth trench 454. In some embodiments, a sixth segment of tungsten is within the sixth trench 456. In some embodiments, the second reflector 206 defines fewer than 50 trenches. In some embodiments, the second reflector 206 defines fewer than 40 trenches. In some embodiments, the second reflector 206 defines fewer than 30 trenches. In some embodiments, the second reflector 206 defines fewer than 20 trenches. In some embodiments, the second reflector 206 defines fewer than 10 trenches.

In some embodiments at least one of the resonator cavity 202, the first reflector 204 or the second reflector 206 are formed at least one of on or within a common substrate. In some embodiments, at least some materials of at least one of the resonator cavity 202, the first reflector 204 or the second reflector 206 are formed within openings formed within the common substrate. In some embodiments, the common substrate comprises silicon.

Figure 5A:
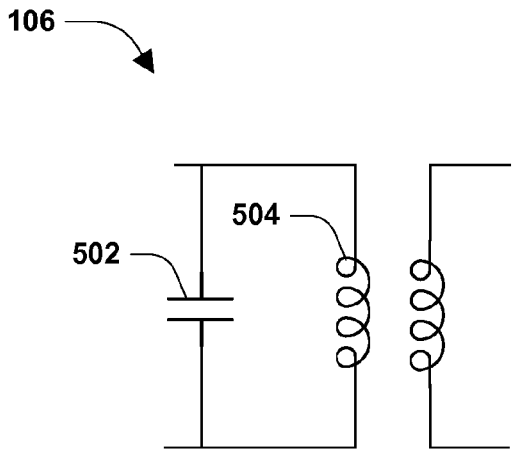
FIG. 5A is an illustration of a circuit, according to some embodiments.

FIG. 5A illustrates the first impedance converter 106, according to some embodiments. In some embodiments, the first impedance converter 106 comprises a first capacitor 502 and a first transformer 504. In some embodiments, the first transformer 504 comprises a primary winding connected to a first side of the first transformer 504. In some embodiments, the first transformer 504 comprises a secondary winding connected to a second side of the first transformer 504. In some embodiments, the first capacitor 502 is connected in parallel with the primary winding of the first transformer 504. In some embodiments, the secondary winding of the first transformer 504 is connected in series with the first variable capacitor 108. In some embodiments, the first capacitor 504 is connected to the input terminal 102. In some embodiments, the first capacitor 504 is connected to the third voltage source 104.

Figure 5B:
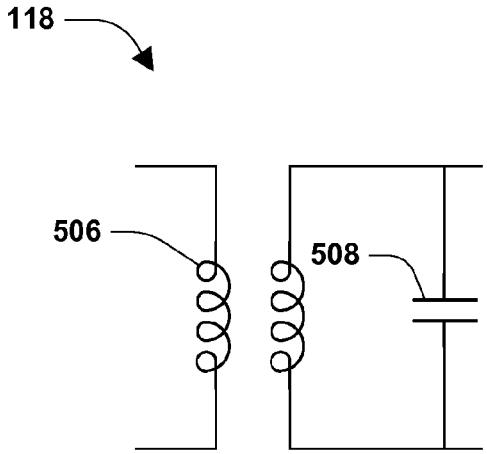
FIG. 5B is an illustration of a circuit, according to some embodiments.

FIG. 5B illustrates the second impedance converter 118, according to some embodiments. In some embodiments, the second impedance converter 118 comprises a second capacitor 508 and a second transformer 506. In some embodiments, the second transformer 506 comprises a primary winding connected to a first side of the second transformer 506. In some embodiments, the second transformer 506 comprises a secondary winding connected to a second side of the second transformer 506. In some embodiments, the second capacitor 508 is connected in parallel with the primary winding of the second transformer 506. In some embodiments, the secondary winding of the second transformer 506 is connected in series with the second variable capacitor 116. In some embodiments, the second capacitor 508 is connected to the output terminal 120. In some embodiments, the second capacitor 508 is connected to the fourth voltage source 122.

In some embodiments, at least one of a capacitance of the first capacitor 502, a coupling coefficient of the first transformer 504, an inductance of the primary winding of the first transformer 504, an inductance of the secondary winding of the first transformer 504, a Q factor of the primary winding of the first transformer 504, or a Q factor of the secondary winding of the first transformer 504 is chosen such that the first impedance converter 106 impedes at least some insertion loss on the band-pass filter 100. In some embodiments, at least one of a capacitance of the second capacitor 508, a coupling coefficient of the second transformer 506, an inductance of the primary winding of the second transformer 506, an inductance of the secondary winding of the second transformer 506, a Q factor of the primary winding of the second transformer 506, or a Q factor of the secondary winding of the second transformer 506 is chosen such that the second impedance converter 118 impedes at least some insertion loss on the band-pass filter 100.

In some embodiments, a typical value for the capacitance of the first capacitor 502 is approximately 3.6 picofarads. In some embodiments, a typical value for the coupling coefficient of the first transformer 504 is approximately 0.7. In some embodiments, a typical value for the inductance of the primary winding of the first transformer 504 is approximately 0.65 nanohenries. In some embodiments, a typical value for the inductance of the secondary winding of the first transformer 504 is approximately 20 nanohenries. In some embodiments, a typical value for the Q factor of the primary winding of the first transformer 504 is approximately 15. In some embodiments, a typical value for the Q factor of the secondary winding of the first transformer 504 is approximately 5. In some embodiments, a typical value for the capacitance of the second capacitor 508 is approximately 3.6 picofarads. In some embodiments, a typical value for the coupling coefficient of the second transformer 506 is approximately 0.7. In some embodiments, a typical value for the inductance of the primary winding of the second transformer 506 is approximately 0.65 nanohenries. In some embodiments, a typical value for the inductance of the secondary winding of the second transformer 506 is approximately 20 nanohenries. In some embodiments, a typical value for the Q factor of the primary winding of the second transformer 506 is approximately 15. In some embodiments, a typical value for the Q factor of the secondary winding of the second transformer 506 is approximately 5.

Figure 6:
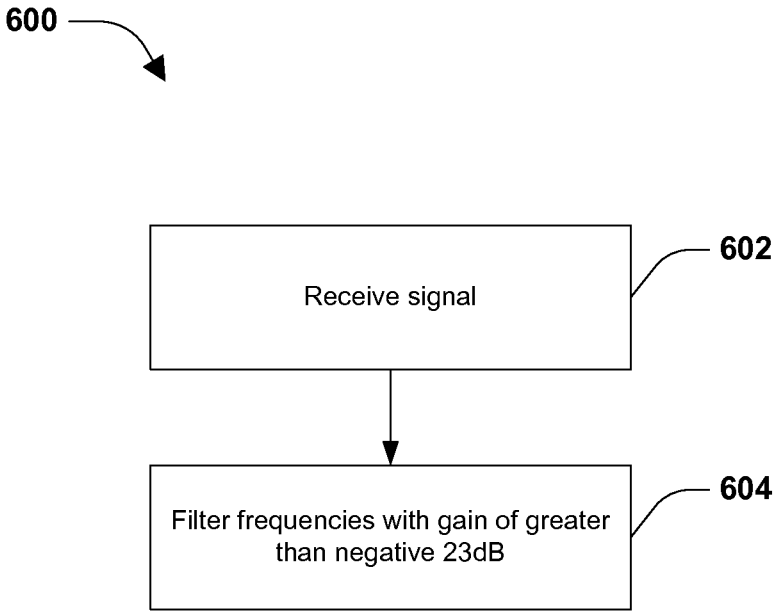
FIG. 6 is a flow diagram illustrating a method for operating a band-pass filter, according to some embodiments.

FIG. 6 illustrates a method 600 for operating a band-pass filter comprising a CMOS resonator. At 602, the band-pass filter receives a signal. At 604, the band-pass filter filters frequencies from the signal using the CMOS resonator such that a non-filtered portion of the signal is transmitted with a gain of greater than about negative 23 decibels. In some embodiments, the non-filtered portion of the signal comprises frequencies ranging between about 3.25 gigahertz to about 3.35 gigahertz.

In some embodiments, the first impedance converter 106 and the second impedance converter 118 are respectively configured such that the band-pass filter 100 operates at a transmission of approximately negative 5.8 decibels, at a frequency of approximately 3.3 gigahertz with a Q factor of approximately 480.

In some embodiments, the first variable capacitor 108 and the second variable capacitor 116 are respectively configured to tune the band-pass filter to operate at a desired frequency. In some embodiments, the first variable capacitor 108 can vary from approximately 0.5 femtofarads to approximately 1 femtofarad. In some embodiments, the second variable capacitor 116 is set substantially equal to the first variable capacitor 108. In some embodiments, as the first variable capacitor 108 and the second variable capacitor 116 are respectively changed from approximately 0.5 femtofarads to approximately 1 femtofarad, a peak transmission operating frequency of the band-pass filter 100 changes from approximately 3.36 gigahertz to approximately 3.44 gigahertz.

According to some embodiments, a band-pass filter is provided that comprises a first impedance converter connected to an input terminal. The band-pass filter also comprises a second impedance converter connected to an output terminal. The band-pass filter also comprises a resonator connected to the first impedance converter and to the second impedance converter. The resonator comprises a resonator cavity and a first reflector.

According to some embodiments, a band-pass filter is provided. The band-pass filter comprises a CMOS resonator comprising a first reflector and a resonator cavity. The resonator cavity comprises arsenic. The band-pass filter also comprises a first impedance converter.

According to some embodiments, a method of operating a band-pass filter is provided. The method comprises receiving a signal at the band-pass filter. The method also comprises filtering frequencies from the signal using a CMOS resonator of the band-pass filter such that a non-filtered signal passes through the band-pass filter, the non-filtered signal having a frequency of between about 3.25 gigahertz to about 3.35 gigahertz and is transmitted with a gain of greater than negative 23 decibels.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed as to imply that these operations are necessarily order dependent. Alternative ordering will be appreciated given the benefit of this description. Further, it will be understood that not all operations are necessarily present in each embodiment provided herein. Also, it will be understood that not all operations are necessary in some embodiments.

Further, unless specified otherwise, "first," "second," "third," "fourth," "fifth," "sixth," "seventh," "eighth," or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or identical channels or the same channel. In an example, unless specified otherwise, the presence of a "second" does not necessarily imply the presence of a "first," the presence of a "third" does not necessarily imply the presence of a "first" or "second," the presence of a "fourth" does not necessarily imply the presence of a "first," "second," or "third," the presence of a "fifth" does not necessarily imply the presence of a "first," "second," "third," or "fourth," the presence of a "sixth" does not necessarily imply the presence of a "first," "second," "third," "fourth," or "fifth," the presence of a "seventh" does not necessarily imply the presence of a "first," "second," "third," "fourth," "fifth," or "sixth," the presence of an "eighth" does not necessarily imply the presence of a "first," "second," "third," "fourth," "fifth," "sixth," or "seventh," and the presence of a "ninth" does not necessarily imply the presence of a "first," "second," "third," "fourth," "fifth," "sixth," "seventh," or "eighth." Also, the presence of a "first" does not necessarily imply the presence of a "second," "third," "fourth," "fifth," "sixth," "seventh," or "eighth."

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A band-pass filter, comprising:

a first impedance converter connected to an input terminal and comprising a first transformer having a primary winding and a secondary winding;

a second impedance converter connected to an output terminal; and a resonator connected to the first impedance converter via the first transformer and connected to the second impedance converter, the resonator comprising:

a substrate;

a first reflector comprising a first material disposed within a first trench in the substrate, the substrate surrounding sidewalls and a bottom surface of the first material; and a resonator cavity comprising:

a second material disposed within a second trench in the substrate, the second material defining an inner trench; and a second instance of the first material disposed within the inner trench, wherein:

the input terminal is connected to the primary winding of the first transformer and the resonator is connected to the secondary winding of the first transformer; and there is no current path from the input terminal to the resonator.

2. The band-pass filter of claim 1, the second impedance converter comprising a second transformer.

3. The band-pass filter of claim 2, the second transformer comprising:

a primary winding connected to the resonator; and a secondary winding connected to the output terminal.

4. The band-pass filter of claim 3, the second impedance converter comprising a second capacitor connected in parallel with the secondary winding of the second transformer.

5. The band-pass filter of claim 3, comprising a second variable capacitor connected in series with the primary winding of the second transformer.

6. The band-pass filter of claim 1, the first impedance converter comprising a first capacitor connected in parallel with the primary winding of the first transformer.

7. The band-pass filter of claim 6, comprising a first variable capacitor connected in series with the secondary winding of the first transformer.

8. The band-pass filter of claim 1, the resonator comprising:

a second reflector.

9. The band-pass filter of claim 8, at least one of the first reflector comprising a first acoustic Bragg reflector; or the second reflector comprising a second acoustic Bragg reflector.

10. The band-pass filter of claim 1, the resonator cavity comprising an n-type dopant in a first portion of the substrate, wherein the second material is in contact with the first portion of the substrate and in contact with an undoped portion of the substrate.

11. The band-pass filter of claim 10, wherein the n-type dopant is arsenic.

12. The band-pass filter of claim 1, comprising a first variable capacitor connected between the secondary winding of the first transformer and the resonator.

13. The band-pass filter of claim 12, comprising a second variable capacitor connected between the second impedance converter and the resonator, a capacitance of the second variable capacitor substantially matched to a capacitance of the first variable capacitor.

14. The band-pass filter of claim 1, the first material comprising tungsten.

15. The band-pass filter of claim 1, the first material comprising tungsten and the second material comprising silicon nitride.

16. A band-pass filter, comprising:

a CMOS resonator comprising a first reflector and a resonator cavity, the resonator cavity comprising:

a substrate comprising a doped region and defining a first trench at a first end of the doped region and a second trench at a second end of the doped region opposite the first end, the first trench and the second trench having depths that exceed a depth of the doped region; and a first material, different than the substrate, disposed within the first trench and the second trench;

and a first impedance converter.

17. The band-pass filter of claim 16, the first reflector comprising a first acoustic Bragg reflector.

18. The band-pass filter of claim 16, the first reflector comprising tungsten disposed within a third trench defined by the substrate, the substrate surrounding sidewalls and a bottom surface of the tungsten.

19. The band-pass filter of claim 16, wherein the first material defines a first inner trench within the first trench and a second inner trench within the second trench, and tungsten is disposed within the first inner trench and the second inner trench.

20. A band-pass filter, comprising:

a CMOS resonator comprising a first reflector and a resonator cavity, wherein:

the resonator cavity comprises:

a first material disposed within a first trench and a second trench defined by a substrate, the first material defining a first inner trench within the first trench and a second inner trench within the second trench;

a second material disposed within first inner trench and the second inner trench; and a doped region of the substrate between the first trench and the second trench, wherein the doped region of the substrate contacts a first sidewall of the first material and an undoped region of the substrate contacts a second sidewall of the first material; and the first reflector comprises:

the second material disposed within a third trench and a fourth trench defined by the substrate.

* * * * *